US005520424A

United States Patent [19]

Hapke et al.

[11] Patent Number: 5,520,424

[45] Date of Patent: May 28, 1996

[54] TAMPER-PROOF DOOR SWITCH AND LATCH DEVICE

[75] Inventors: Kenyon A. Hapke, Libertyville, Ill.; Spencer C. Schantz, Dousman, Wis.

[73] Assignee: U.S. Controls Copr., New Berlin, Wis.

[21] Appl. No.: 380,308

[22] Filed: Jan. 30, 1995

[51] Int. Cl.[6] ..... E05C 3/06

[52] U.S. Cl. ..... 292/198; 292/251.5; 292/337; 292/341.7; 292/DIG. 69

[58] Field of Search ..... 292/DIG. 69, 251.5, 292/337, 341.17, 219, 198

[56] References Cited

U.S. PATENT DOCUMENTS

| | | | |
|---|---|---|---|
| 2,751,053 | 6/1956 | Birkemeier | 292/341.17 |
| 3,890,813 | 6/1975 | Cothron | 292/198 X |
| 4,755,647 | 7/1988 | Nishikawa et al. | 292/DIG. 69 X |
| 5,176,417 | 1/1993 | Bauer | 292/201 |

FOREIGN PATENT DOCUMENTS

| | | | |
|---|---|---|---|
| 2303226 | 8/1974 | Germany | 292/DIG. 69 |

*Primary Examiner*—Rodney M. Lindsey
*Attorney, Agent, or Firm*—Ryan, Maki, Mann & Hohenfeldt

[57] ABSTRACT

In a door latching and switch contact controlling device, an actuator having first and second radially extending angularly spaced apart members is mounted on a common shaft in a housing with a latching member for the member and actuator to rotate together. A striker fastened to a door strikes the first radially extending member when the door closes to turn the actuator so the second member rotates into an opening in the striker to thereby conceal the first member. An electroresponsive device positions a latching element into the path of a stop on the latching member when the device is energized, thereby preventing the actuator from turning reversely if an attempt is made to open the door. The device locks the door if it is closed, if the actuator is rotated by the striker and the electroresponsive device is energized, whereupon a pair of contacts are compelled to make contact to complete a circuit for signalling a controller that it can initiate existence of a hazardous condition that is prevented from being accessed by the locked door.

27 Claims, 7 Drawing Sheets

FIG. 12
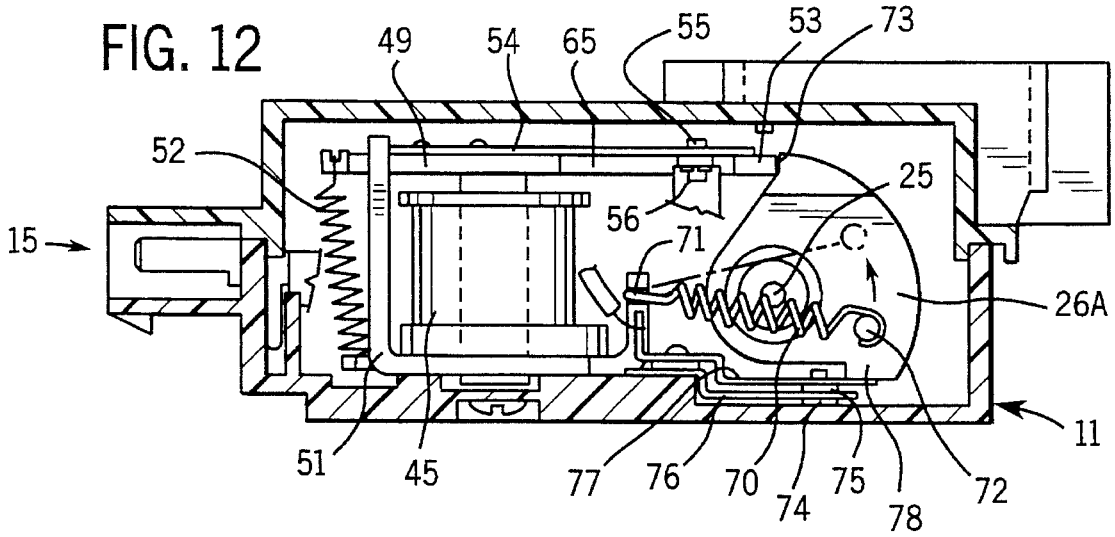
FIG. 13
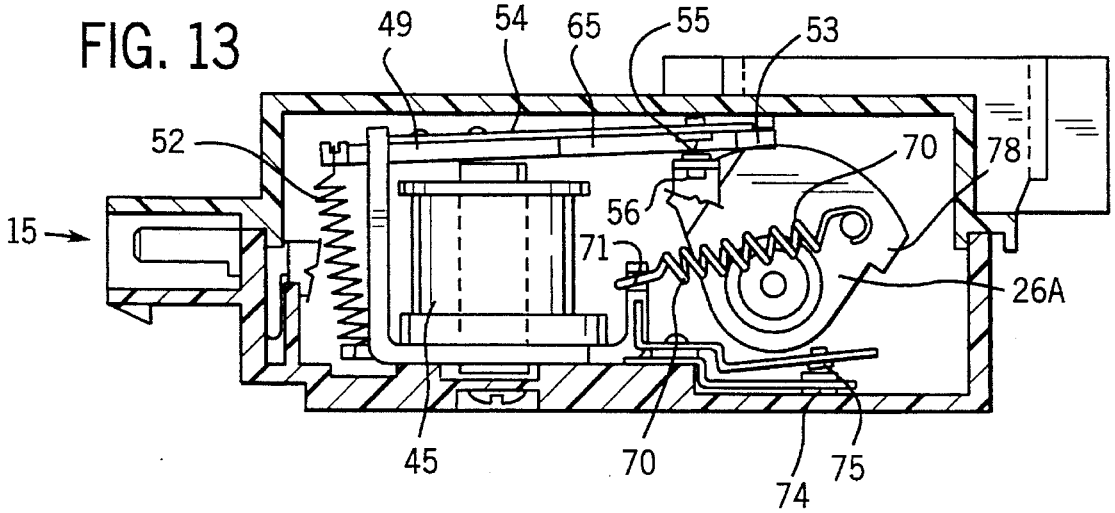
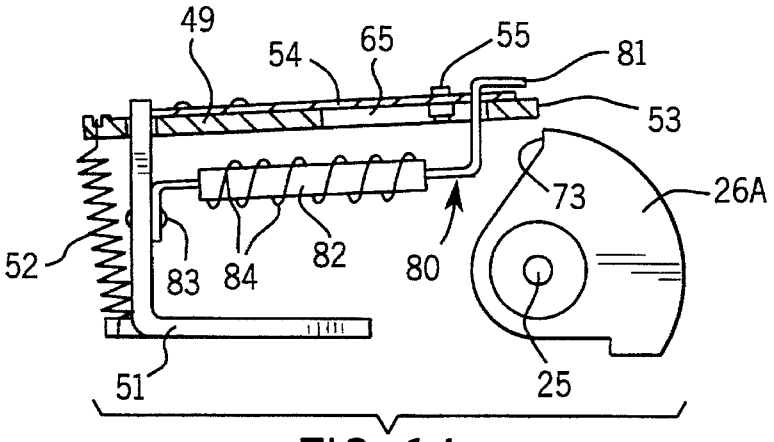
FIG. 14

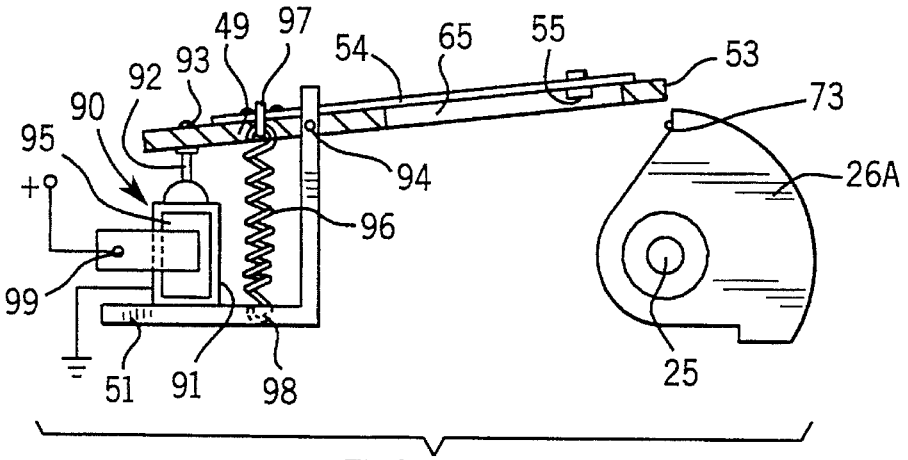
FIG. 15
FIG. 16
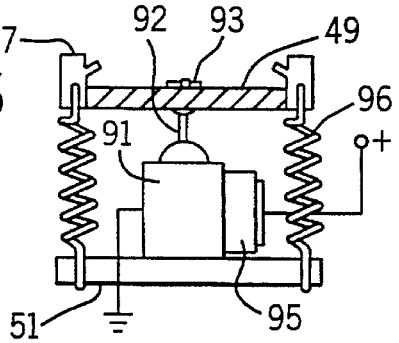
FIG. 17
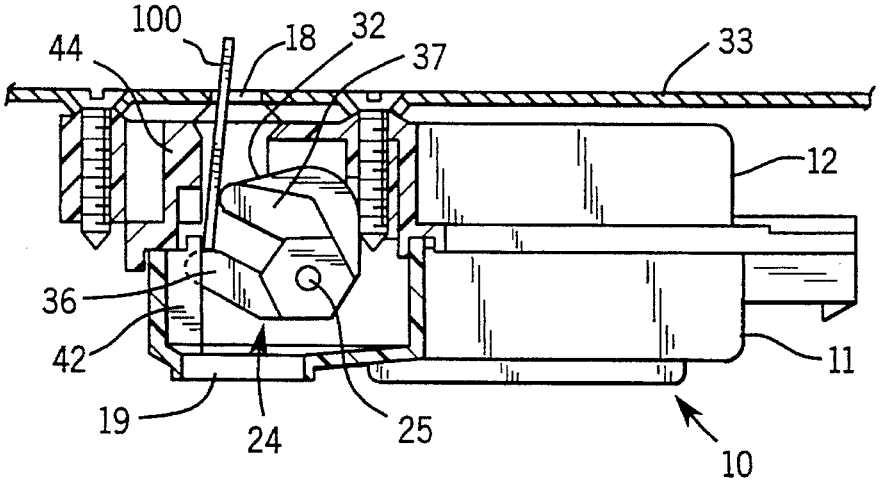

TAMPER-PROOF DOOR SWITCH AND LATCH DEVICE

BACKGROUND OF THE INVENTION

The invention disclosed herein pertains to a tamper-proof switch and latch device.

There are many cases where access by persons to electrical, mechanical and hot equipment, for example, must be prevented until safe conditions prevail. Typically, such equipment is installed within an enclosure in which there is a door that should not be openable unless the equipment is deenergized, stopped or cooled.

Residential automatic clothes washing machines, which are familiar to most persons, provide one example of a situation where some degree of protection is provided against the user being injured by becoming entangled with the spin dryer which is still spinning after the access door is opened. The protective device used in existing machines is usually a door operated switch that is operated to an open circuit state by opening the door. The open switch deenergizes the motor that drives the spinning basket rotationally at high speed. Although some clothes washing machines apply a braking means concurrently with deenergization of the motor, it is common for the basket to still be coasting at a fairly high speed after the access door is opened. Thus, there is some risk of a user being injured until the basket comes to a complete stop.

SUMMARY OF THE INVENTION

An objective of the invention is to provide a device for holding a closure device such as a door, lid or cover in a latched closed state for as long as any conditions that may cause injury exist in the enclosure and that allows the closure to be opened and closed freely if such conditions do not exist. For the sake of simplicity in this specification the word "door" is used as a generic term for designating closures including but not limited to doors, lids and covers.

Another objective is to provide a door switch and latching device which is tamper proof and has protective capabilities that are difficult to evade or defeat.

Still another objective is to provide a door switch and latching device that can be used in a wet environment such as, but not limited to, laundry equipment.

The new door switch and latching device comprises a compartmentalized housing preferably made of a non-conductive plastic material. An actuator is journaled for rotation in forward and reverse directions in a compartment of the housing. Mounted to or molded integrally with the actuator is a first radially extending striker actuating member and a second radially extending capturing member. These members are angularly spaced from each other about the actuator axis. A return preloaded spring, preferably a torsion spring, biases the actuator in the reverse rotational direction. A striker that is mounted to the door of an enclosure, for example, is arranged to extend through an aperture in the device housing by closing the door. Striking of the first radially extending member of the actuator causes it to rotate in the forward direction to thereby overcome the force of the torsion spring with the result that the second radially extending striker capturing member rotates through the same angle as the first member and thereby overlays, conceals and captures the striker between the first and second radially extending members. The door is not locked even though the striker is inserted unless other conditions are satisfied as will be outlined below.

A latching member having a radially extending stop element is arranged in axially spaced relationship with the actuator. The latching member can be a disk or segment of a disk or a cam that has a certain relatively large radius over part of its periphery but reduces abruptly at a certain point along its periphery to define a riser or stop constituting the aforesaid stop element. An operator comprised typically of an electromagnet coil and magnetic pole piece is positioned adjacent the latching member. An armature, serving as a latch, in the form of a flat magnetizable clapper or finger is pivotally mounted and extends over the pole piece in the coil for being attracted to the pole piece when the coil is energized and for being pulled away from the pole piece under the influence of a spring when the coil is deenergized. The operator could be of the type in which the pole piece or latching element is a magnetizable plunger that is centered in the coil and is biased in opposition to the magnetic force of the coil.

If the striker on the door is inserted in the switch and latching device through the aperture in the housing, the first and second radially extending members of the actuator are rotated as described above, and if the coil is not energized, the armature constituting the latching element remains spring biased out of engagement with the latching member. The door can still be opened. When access to the interior of the enclosure should be denied because a hazardous condition in the enclosure is expected or exists, the relay coil becomes energized. For example, a programmable controller in a clothes washing machine may determine that a high speed spin drying cycle should begin so the controller effects energization of the coil. In other equipment other types of sensors may be used to sense when the door must be locked. This drives the latching element into engagement with the latching member stop. Thus, the latching member is blocked against rotating oppositely of the direction in which the striker rotated it when the striker struck the first radially extending actuator member when the door was closed. Now, the door cannot be opened until the coil is deenergized since the latching member is blocked against rotation by the magnetic latch element being positioned in interfering relationship with the stop on the latching member.

When the actuator and latching member became blocked against rotation by the magnetic latching element being moved into engagement with the latching member a movable electric contact is driven into contact with a stationary contact in the housing of the device. This results in closing a circuit that sends a signal to the programmable controller or other signal receptive device indicating that the door is locked securely. The controller, in the clothes washer application of the new device, responds by emitting control signals that control a motor to begin high speed spin drying, for example, or to allow some other hazardous condition to exist in whatever enclosure is under consideration. The coil is deenergized so the door can open, usually at the expiration of a time interval, that starts to run when hazardous conditions do not exist. In a washing machine, for example, the time delay affords an opportunity for the rotating basket to coast to a complete stop before the door can be opened.

How the foregoing and other objectives and features of the invention are implemented will appear in the ensuing more detailed description of a preferred embodiment of the invention which will now be set forth in reference to the drawings.

DESCRIPTION OF THE DRAWINGS

FIG. 12 is a view wherein the cam is biased with a coil spring which is connected to produce a toggle action and the cam is configured for closing an additional electric contact for signalling that the door is closed whether or not it is latched;

FIG. 13 shows that the cam toggled to an angular position in which it allows the additional contact to open;

FIG. 14 is a diagram of an alternative device for latching a door closed using a bimetal to drive a latch member into a position for blocking a cam against rotation;

FIG. 15 is a diagram of an alternative device for latching a door closed using a wax motor to drive a latch member into a position for blocking a cam against rotation;

FIG. 16 is a left side elevational view of the device depicted in FIG. 15; and FIG. 17 is a view used for demonstrating an unsuccessful attempt to defeat the safety aspect of the latching and switch device by trying to actuate it while the door is open.

DESCRIPTION OF A PREFERRED EMBODIMENT

Figure 1:
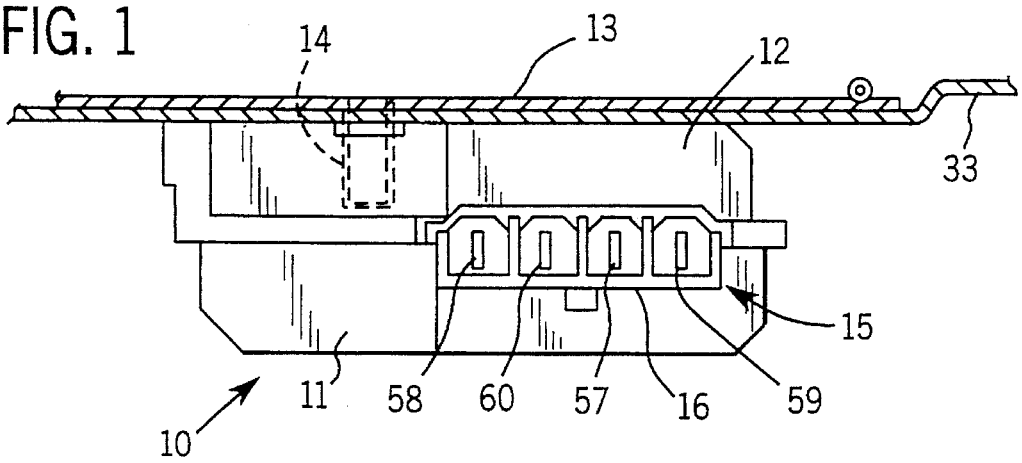
FIG. 1 is a rear end view of the housing that contains the components of the new switch and latch device.

In FIG. 1 the housing for the device is designated generally by the reference numeral 10. The housing comprises a lower part 11 and an upper part 12. The housing would ordinarily be mounted in a fixed position within an enclosure such as a domestic washing machine, dryer, or an enclosure for high voltage electrical components with which a user must not come in contact until parts within the enclosure have stopped rotating or have been deenergized. A fragment of a sheet metal top or wall 33 of an enclosure is shown. The hardware for supporting the housing in an enclosure is not depicted. A fragment of a hinged door 13 for accessing the interior of the enclosure 33 is identified by the numeral 13 in FIG. 1. A striker for actuating the actuator within the housing is depicted in dashed lines in FIG. 1 and is identified by the numeral 14. The striker is fastened to the door 13.

In the FIG. 1 embodiment, there are four electrical connector prongs 15 extending out of the bottom part 11 of the housing for connecting electric circuit elements in the enclosure to a programmable microprocessor based controller which is not shown. Although the new device may be used for protection purposes on a variety of appliances for the sake of clarity that comes from a concrete example of its use, the functions of the device will be explained as if it is affiliated with a domestic clothes washing machine. During one interval of an operating cycle of a clothes washing machine, as is well-known, the clothes are subjected to spinning at high speed to expel the water. It is important to not let the user have access through an open door to the interior of the washing machine enclosure until it is certain that the spinning basket has come to a complete stop or is moving at a safe speed. The protective device disclosed herein latches the door closed at any time that hazardous conditions exist within the enclosure. The device prevents the door from being opened as long as the controller sends a signal to the device that a dangerous condition exists inside of the enclosure. Moreover, the device signals the controller when the door is latched closed so that the controller is enabled to initiate a spin cycle. In the FIG. 12 embodiment auxiliary electric contacts are provided for signalling that the door is closed even though the door may not be latched.

Figure 2:
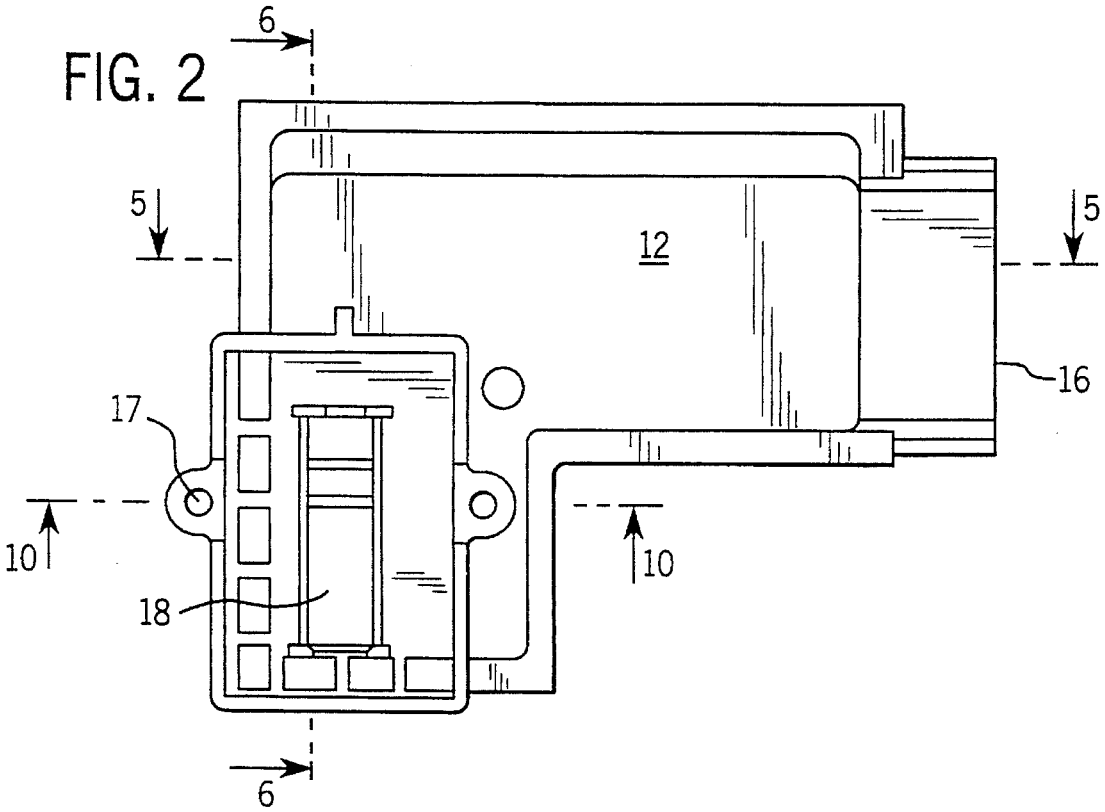
FIG. 2 is a top plan view of the device looking at the cover of the housing.

FIG. 2 is a top plan view of the housing for the device having an end 16 constituting a socket containing the connector prongs 15 which are shown in FIG. 1. The housing is provided with flange elements such as the one marked 17 for anchoring it in a fixed position within the interior of an enclosure. The top part 12 of the housing has a rectangular aperture 18 which allows entry of the striker 14 into the device for actuating it to establish a preliminary condition for allowing the door to be latched when a hazardous condition exists within the enclosure.

Figure 3:
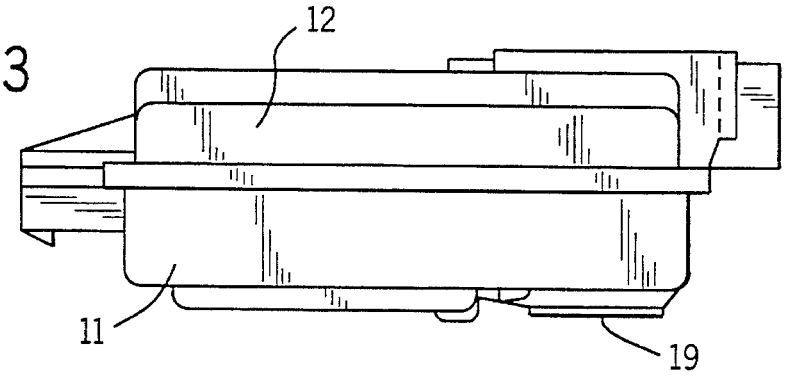
FIG. 3 is a side elevational view of the device.
Figure 4:
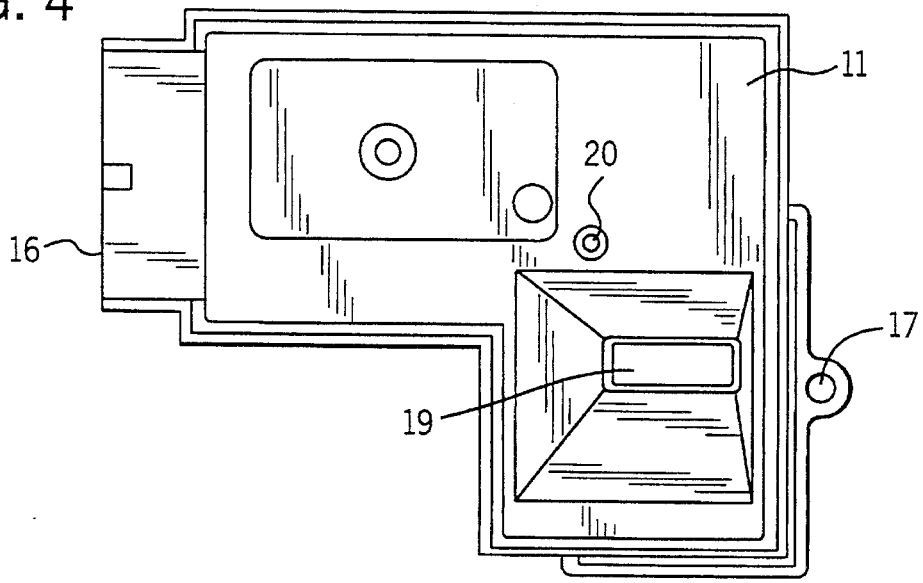
FIG. 4 is a bottom plan view of the device.

FIG. 3 is a side elevational view of the device comprised of bottom and top housing parts 11 and 12 which, in conjunction with FIG. 4 illustrate that there is a drain opening 19 in the bottom of the housing. There is also a small drain hole 20, whose purpose will be described later, in the bottom part 11 of the housing.

Figure 8:
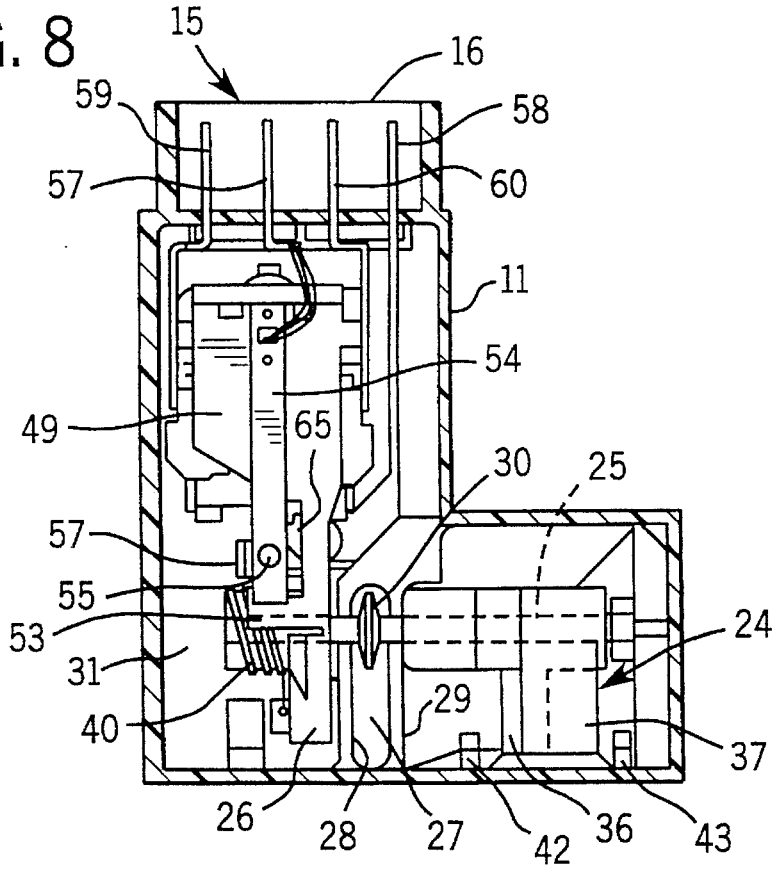
FIG. 8 is a top plan view of the device as viewed with the top part of the housing removed.

Attention is now invited to FIG. 8 for identifying some of the parts of the device which are involved in carrying out its protective functions. The actuator for the device is generally designated by the numeral 24. The actuator is fixed on a shaft 25 which is journaled for rotation in grooved housing parts 11 and 12. The shaft has actuator 24 fastened to it. On the same shaft, a latching member 26, somewhat like a cam, is also fastened. A small compartment 27 is defined between walls 28 and 29. The shaft, 25 passes through this compartment where it has a drip ring 30 fastened to it. The purpose of the drip ring is to preclude any water that may creep along shaft 25 from entering into proximity with electrical components situated in the space marked 31. The drip ring is actually a disk that tapers from both sides radially outwardly from its center to provide a periphery which induces water to drip off a ring and fall into compartment 27 for draining out. The drip ring may be molded integrally with the shaft. Although it is not visible in FIG. 8, the drain hole 20 mentioned in connection with FIG. 4 passes through the bottom of the housing for draining any liquid that may drop into compartment 27.

Figure 6:
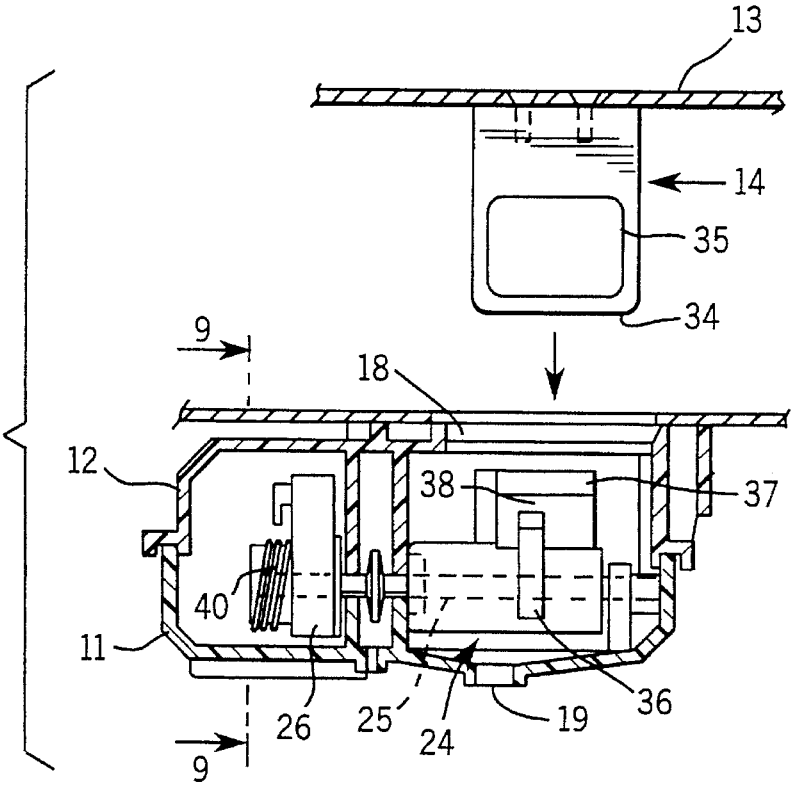
FIG. 6 is a vertical sectional view of the device taken on a line corresponding to 6—6 in FIG. 2 with the actuating striker shown in readiness for being inserted in device actuating position.
Figure 10:
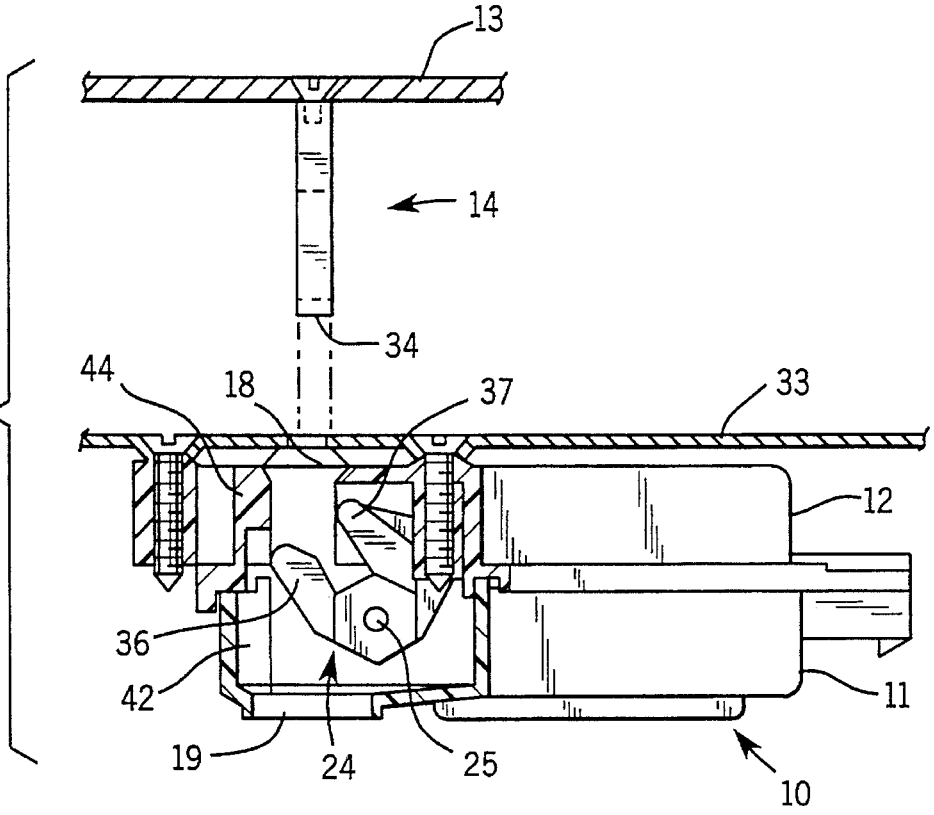
FIG. 10 is a vertical sectional view, taken on a line corresponding to 10—10 in FIG. 2 and showing the actuator striker in readiness for being inserted in the device.

Refer now to FIG. 10 where the new device 10 is shown mounted to an enclosure having a sheet metal top 33. The striker 14 is in readiness for being plunged into the housing through opening 18. The striker would normally be mounted to a door which, when swung closed, drives the striker into the housing 10. The configuration of the striker may be seen in FIG. 6, for example, where it is shown to terminate in an open loop having a cross bar 34 spanning between its legs 35. In FIGS. 6 and 10, and the striker 14 is poised to plunge into the housing for striking the first radially extending member 36 of actuator 24 and rotating it. It will be apparent that actuator 24 is comprised of unitary first and second members 36 and 37 which project radially outwardly from the axis of shaft 25. The space or gap between actuator members 36 and 37 is marked 38. In FIG. 10 the actuator 24 is still in unactuated condition.

Figure 11:
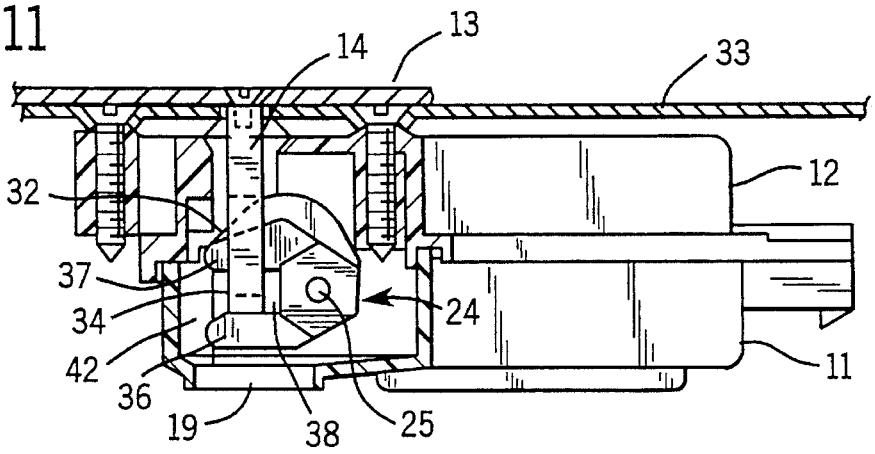
FIG. 11 is a sectional view that is basically the same as FIG. 10 except that the actuator striker is shown inserted in the device.

In FIG. 11, the striker 14 has been inserted into the housing by reason of the door on the appliance having been closed. Upon this event, the striker strikes radially extending member 36 of actuator 24 to thereby cause the actuator to rotate counterclockwise as viewed in FIG. 11 as has already been accomplished in that Figure. It will observed in FIG. 10 that radially extending actuator members 36 and 37 are angularly spaced apart from each other about the axis 25 of the actuator. This provides a free space 38 between angularly spaced apart members 36 and 37 of the actuator so that when the striker strikes the first radially extending member 36 the actuator begins to rotate and the cross member 34 of striker enters the space between the angularly spaced apart members 36 and 37 so that, upon turning, the angularly lagging radially extending member 37 swings into the open loop in the striker above the cross bar 34. In other words, the cross bar is now captured between radially extending members 36 and 37 of the actuator 24. As will be explained, means are provided for locking the actuator 24 in actuated condition as in FIG. 11. For the moment, one may assume that the door 13 is closed, the striker is set as in FIG. 11, but the actuator is not locked against rotation. Thus, the door may be opened and closed because the assumption is that a hazardous condition within the enclosure does not exist as yet.

As is apparent in FIG. 6, member 37 of actuator 24 is longer in the axial direction than is integrally formed member 36. The profile of the actuator can be seen in FIG. 10 where the actuator is presently in its non-rotated unactuated position and is being constrained in that position tentatively by a torsion spring 40 which appears in FIGS. 6 and 9 besides other Figures. In FIG. 11, on the other hand, actuator 24 is driven rotationally to its activated position which corresponds to position in which it participates in maintaining the enclosure door 14 locked as will be explained. In FIG. 11, the door 13 is closed and the actuator 24 is rotated counterclockwise compared to FIG. 10 by reason of the striker 14 cross bar 34 having entered the gap 38 between actuator members 36 and 37 to rotate the actuator as the door 13 is closed. The top surface 32 of radial actuator member 37 is curved for making avoidance of the tamper proof feature as will be elaborated later in reference to FIG. 17.

FIGS. 10, 11 and 17 show a blocking element projection 42 molded in the bottom half 11 of the housing 10. FIG. 8 shows the top of another blocking element projection 43 which is similar to projection 43 and is spaced from it. One may see in FIGS. 8 and 11, for example, that when the actuator members 36 and 37 arrive between spaced apart blocking elements 42 and 43. FIG. 10 and 11 also show another blocking element 44 which is molded integrally with the upper part 12 of the housing and is slotted and bevelled to let members 36 and 37 pass when the actuator 24 is rotated from its FIG. 10 position to its FIG. 11 position by striker 14. As will be explained in detail later in reference to FIG. 17, the blocking elements are involved in making the locking and switching device 10 tamper proof, that is, making it difficult to defeat the safety purposes of the device.

Figure 5:
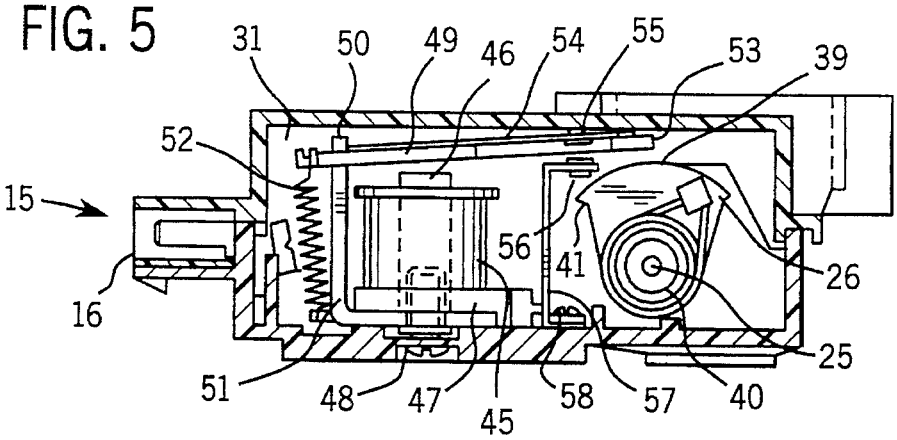
FIG. 5 is a vertical sectional view of the device taken on a line corresponding to 5—5 in FIG. 2.
Figure 9:
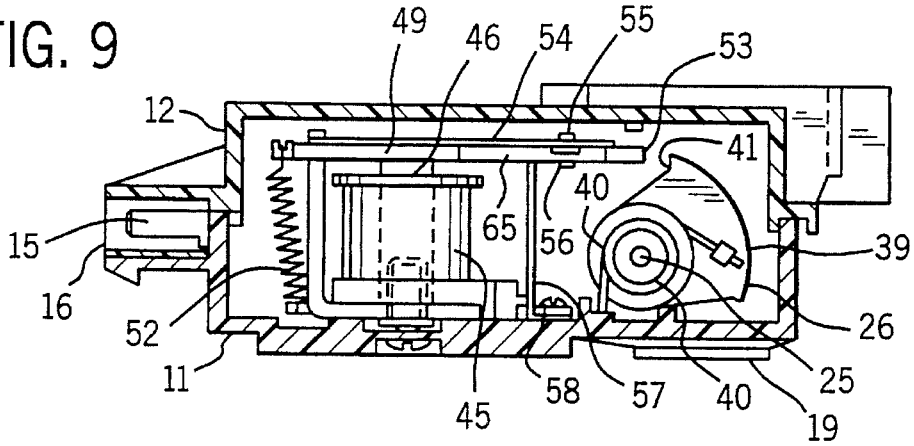
FIG. 9 is a vertical sectional view taken on a line corresponding to 9—9 in FIG. 6 showing the arrangement of the parts after the striker is inserted.

A latching member 26 was briefly alluded to in reference to FIG. 8. This member is, as previously explained, fastened to shaft 25 so as to couple it for joint rotation to actuator 24. The profile of the latching member 26 can be seen in FIGS. 5 and 9 particularly well. It's periphery constitutes a segment of a circle 39 which is also a camming surface. A torsion spring 40, serving as a return spring, is fastened at one end to the housing part 11 and the other end is fastened to latching member 26 to bias latching member 26 in a direction of rotation opposite of the direction in which the latching member 26 and actuator 24 turn when the striker 14 is inserted. In other words, the spring biases latching member 26 in a counterclockwise direction as viewed in FIG. 5. The torsion spring is preloaded for rotating the latching member 26 into the angular position in which it is shown in FIG. 5. It will be understood, that a preloaded coil spring shown in FIGS. 12 and 13 could be used in place of torsion spring 40 which would involve having one end of the coil spring attached to the latching member 26 and the other end attached to the housing. Notice also in FIG. 5 that the latching member 26 is provided with a radially extending riser 41 which serves as a stop element for stopping latching member 26 against counterclockwise rotation. In FIG. 9, on the other hand, the striker 14 is assumed to have been inserted in which case latching member 26 is rotated and secured in the position in which it is shown in FIG. 9 after having been rotated clockwise relative to its position in FIG. 5.

Referring again to FIG. 5, one may see that there is an electromagnet coil 45 mounted within space 31 of the housing. The coil is fitted on a magnetizable core 46. The core 46 is secured to a flat surface 47 by means of a screw 48 which threads into the core. A flat blade constituting an armature 49 is pivotally mounted at a point 50 on a magnetizable frame 51 which is also secured with screw 48.

Core 46 can either have low magnetic remanence, in which case energization of coil 45 must be maintained to keep armature 49 (latch element) engaged with core 46, or remanence can be high in which case a strong engage pulse is required to engage latch element 49. Alternatively, a permanent magnet core could be used such that a magnetically aiding electric pulse attracts latch element 49 which is held by the permanent magnetism and released by a lower energy reverse electric pulse.

With pulse operation, if the door 13 is open, latching member 26 is blocking latching element 49 from being engaged with core 46 even though the coil receives a first control pulse from the controller. Thus, when the door is closed by the user so the latching member 26 is rotated as it is in FIG. 9, a second pulse must be applied to the coil to attract the latching element 49 to the core latching the door.

The armature 49 is in the nature of a clapper but it actually serves as a latch element for blocking the latching member 26 against counterclockwise rotation if someone attempts to pry the door 13 open. The configuration of the armature, hereafter called the latch element 49 can be seen most clearly in the FIG. 8 plan view.

In FIG. 5, the latching element 49 is presently not in contact with magnetizable core 46 because it is constrained in the angular position in which it is shown by means of a coil spring 52 which is in tension. The outermost tip 53 of magnetically attractable latch element 49 is presently spaced from camming surface 39 of latching member 26, but the tip is limited in the movement it could make by cam surface 39. Thus, even if coil 45 were presently energized, the magnetic latching 49 element cannot be attracted sufficiently to reach the core 46. Latching element 49 has a flat electrically conductive, preferably bronze, spring 54 fastened to it as can be seen in FIGS. 5, 8 and 9. There is an electric button or point contact 55 fastened to flat conductive spring 54. Contact 55 is movable with magnetizable latching element 49 into electrical contact with a stationary contact 56 so contacts 55 and 56 are elements of a switch in a circuit. The circuit includes connector prongs 57 and 58 to provide for leading to the programmable controller, not shown, that controls various functions of the machine. The controller also serves the purpose of determining whether safe conditions exist before, a basket in a washing machine is enabled to spin at high speed to centrifuge water from clothes. Another pair of connector prongs 59 and 60 are connected to the leads of coil 45 and also lead to the programmable controller which is programmed to energize and deenergize the coil at appropriate times such as when a spin cycle is to be initiated or is stopped, respectively. Note that stationary contact 56 is mounted to a metal support 57 which is secured in the housing by means of a screw 58.

It is important to observe in FIGS. 5, 8 and 9, for example, that the tip 53 of magnetizable latching element 49 extends laterally of the latching element and results from a notch or gap 65 having been stamped out of the element. As is evident in FIGS. 5 and 8, the distal end of flat conductive spring 54 is spring biased such that is rests on tip 53 of latch element 49 when magnet coil 45 is not energized so it is impossible for contact point 55 on flat spring 54 to make contact with stationary contact point 56 as long as cam surface 39 is in the way. Expressed in another way, the arrangement guarantees that contact point 55 cannot touch contact point 56 unless cam surface 39 of latch member 25 is rotated out of the way. This assures that contacts 55 and 56 cannot touch unless the striker 14 has turned actuator 24 to its FIG. 11 position and latch member 26 to its FIG. 9 position by reason of door 13 being fully closed. Because the distal end of the flat contact spring 54 can rest on the tip 53 of latch element it is possible to have spring 54 prestressed so its contact point 55 contacts stationary contact point 56 in the latch element when the latter is attracted to magnet pole piece 46.

In FIG. 9, the striker 14 has been inserted in the housing and is captured between the first and second radially extending members 36 and 37 of actuator 24 although those parts are not visible in FIG. 9. Assume now that the programmable controller, not shown, determines that it is time to start a spin cycle so that the door 13 of the appliance enclosure should be latched. Upon this event, the controller causes electromagnet coil 45 to become energized so as to create a magnetic force that would tend to pull the latch element 49 against magnetic core 46. If the door 13 were open, that is, if the striker is not inserted, the tip 53 of magnetic latch element 49 will simply bear on camming surface 39 of the latch member 26 as in FIG. 5 and contacts 55 and 56 will remain separated so they will not close a circuit that allows a signal to the controller which tells the controller that spin drying can be initiated.

In FIG. 9, the assumption is that the door 13 is closed and the electromagnet coil 45 is energized since the controller wants to start a spin dry cycle. Closing the door 13 caused the striker 14 to rotate the actuator 24 and, hence, the latching member 26 so that the tip 53 of latch element 49 is no longer restrained upwardly in opposition to coil spring 52. Consequently, contacts 55 and 56 are able to close and signal the programmable controller that the door is securely latched and the spin dry cycle can be initiated. With the tip 53 of latch element 49 presented in the path of stop element 41 on the latch member 26 it will be impossible to open the door by any substantial amount since this would cause stop element 41 on the cam type latch member 26 to rotate into the tip 53 of latch element 49 against the opposition of torsion spring 40 which would prevent the door from being opened. In a washing machine, the controller may initiate a time delay interval coincident with the moment the motor driving the spin dryer should be deenergized. The time delay interval is long enough to assure that the basket which does the spin drying has coasted to a complete stop. In some machines, detector devices are used to detect when the spin basket has come to a stop. Thus, after expiration of the time interval, coil 48 is deenergized and latch element 49 is retracted by spring 52 from the path of stop 41 on latching member 26 so it is free to turn. Then, the door of the appliance is free to be opened.

Notice that when the appliance door 13 is latched as in FIG. 9, there is a gap between the tip 53 of latching element 49 and stop 41 on latch member 26. The gap is slightly exaggerated in FIG. 9 but the gap serves the useful purpose of allowing some tolerance in the parts so tip 53 assuredly drops into the path of stop 41 when the door is closed. An attempt to open the door would drive stop 41 on latch member 26 into tip 53 of magnetizable latching elements 49.

Figure 7:
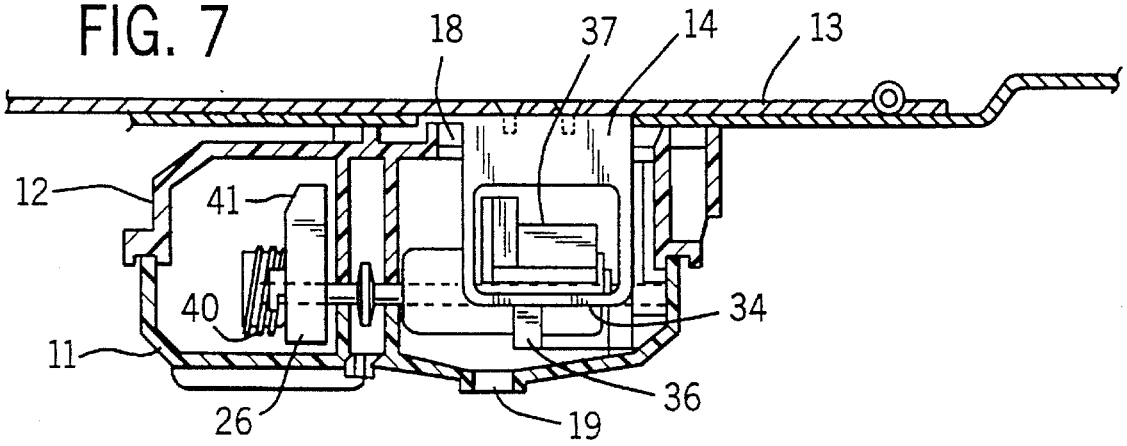
FIG. 7 is a vertical sectional view that is basically the same as FIG. 6 except that the striker is shown inserted into the device.

FIG. 6 shows the position of the radially extending actuator members 36 and 37 and latching member 26 in positions which correlate with their positions in FIG. 5. FIG. 7 shows the first and second radially extending members 36 and 37 on the actuator and the latching member 26 which correlates with their positions in FIG. 9 where the cover is latched.

The opening 18 through which the striker enters the appliance housing and the particular configuration of the radially extending first and second radially extending members 36 and 37 are such that it would be quite difficult to turn the actuator 24 by inserting any sort of an instrument such as a knife, screwdriver or coin which anyone might try to use to defeat the device. In other words, it is not inconceivable that with the door open and the striker retracted someone may try to make the spin cycle start for one reason or another. If the striker is not inserted, the latch element or magnetic armature 49 rests on the curved cam surface 39 of the latching member which is the large diameter part of the circular cam so the latch element 49 could not close the indicator contacts 55 and 56 so there would be no signal to the controller that would otherwise be present if the door were closed and actuated by the striker. The width of radially extending actuator member 37, being much wider than the radially extending member 36, conceals the member 36 and makes it almost impossible to reach member 36 to operate the actuator. Notice also that the radially extending member 37 of the actuator is much wider in the axial direction than the hidden member 36 under it.

Attention is now invited to FIG. 17 for explaining how difficult it is to defeat or evade the tamper proof features of the new door locking and switching device. Assume that someone would like to perform the imprudent act of getting the spin dryer basket to rotate at high speed while the door of the appliance is open. The first approach is likely to be inserting some kind of a tool such as a screwdriver, knife blade, coin or other flat and relatively thin tool through hole 18 where the striker would ordinarily fit if the door were closed. Initially, of course, the actuator 24 would be rotated and at rest in its full clockwise position as is the case in FIG. 10. Assume that a thin, narrow piece of sheet metal or other blade 100 is intended for forcing the actuator 24 to rotate counterclockwise as demonstrated in FIG. 17. This might be done when the relay coil 45 is energized so that switch contacts 55 and 56 would be closed so the controller would have found one condition existing for allowing the basket of the washing machine to spin at high speed. Observe what happens when blade 100 is inserted to apply its force for rotating actuator 24 by pressing on radially extending member 36. It is conceivable that if the article 100 is thin enough that partial rotation of the actuator can be achieved as is illustrated in FIG. 19. However, as the tip of member 36 begins to enter the space between blocking elements 42 and 43 upper member 37 of actuator 34 comes around and jams the tool 100 against blocking element 42 so that further counterclockwise rotation of actuator 24 is stopped sufficiently far ahead of the counterclockwise limit to which it must be turned before the electric contacts 55 and 56 would touch. The person, after having failed to rotate actuator 24 sufficiently to get the basket to spin might consider applying the tool 100 to the curved surface 32 of radially extending member 37 of the actuator. The advantage of having the surface 32 curved is that as the actuator 24 begins to rotate counterclockwise, the surface 32 becomes steeper or more vertical, and the tool 100 pressing on it slides off of the surface and gets jammed up against blocking element 44 and/or blocking elements 42 and 43. It must also be remembered that radially extending member 37 is longer in the direction axially of shaft 25 so that member 37 has member 36 concealed under it immediately after counterclockwise rotation of actuator 24 begins.

Attention is now invited to FIGS. 12 and 13 wherein some alternative structures are shown for accomplishing the same functions that can be accomplished with the previously described embodiment of the switching and door latching device. In FIGS. 12 and 13 the modified cam-like latching member is given the reference numeral 26A. Latching member 26A is fastened to shaft 25 and, as in the previous embodiment, rotates in phase with the actuator 24. The electromagnet coil is the same as in the previously discussed embodiment of the device. Contacts 55 and 56 are the same. The prestressed flat conductive spring member 54 again lies on latching element 49 and the contact 55 projects into a gap or notch 65 in the latch member 49 and the laterally extending end portion 53 of latch element 49 rests on latch member 26A, as in FIG. 13, when latch member 26A is in its unactuated counterclockwise limited position as in FIG. 13. Thus, as in the previously described embodiment, contact 55 can never touch contact 56, unless actuator member 26A is rotated to its set for fully clock-wise position as it is in FIG. 12. In the FIGS. 12 and 13 embodiment, a prestressed helical spring 70 is used in place of a torsion spring to hold the latching member 26A in alternate angular positions. One end of spring 70 is fastened to a hook 71 and the other end is hooked onto a pin 72 which is fixed in latching member 26A. Because pin 72 is at a greater distance from the anchor point 71 of the spring and is radially beyond the axis of shaft 25, a toggle action is obtained. In FIG. 13, the latching member 26A is unactuated, and the axis of the helical spring 70 crosses the axis of shaft 25 to thereby hold latching member 26A in its counterclockwise limited position. In FIG. 12, the actuator has been rotated by insertion of the striker such that cam-like latching member 26A is toggled under the influence of spring 70 to the angular position in which it appears in FIG. 12. Assuming that coil 51 is energized, latch element 49 in FIG. 12 is now positioned in alignment with the stop surface 73 on latching member 26A. As in the previous embodiment, if an attempt is made to open the door of the appliance and withdraw the striker member, the tendency would be to rotate latching member 26A in a counterclockwise direction which would be prohibited by stop surface 73 on latching members 26A butting against the end portion 53 of latching element 49. On the other hand, when coil 51 is deenergized as would be the case when the controller had been informed by sensors that it is safe to open the door of the appliance, tension spring 52 will lock latching element 49 so as to prevent the end 53 of the latching element to block rotation of the latching member 26A.

The FIGS. 12 and 13 embodiment also feature an additional pair of switch contacts 74 and 75 which are in mutual contact in FIG. 12 when the appliance door is closed. One contactor 74 is fastened to a conductive strip 76 and the other contact 75 is fastened to a conductive spring strip 77. A flat stop surface 78 on latching member 26A comes around to press contacts 74 and 75 together when the appliance door is closed as is the case in FIG. 12. Contacts 74 and 75 are for the purpose of closing a circuit, not shown, that provides a signal to the controller indicative of the door being closed.

When the controller indicates that it is safe for the door to be opened, electromagnet coil 45 is deenergized by the controller and spring 52 removes the tip 53 of latching element 49 from the path of stop 73 on latching member 26A. Thus, when the door of the appliance is opened, latching member 26A is rotated counterclockwise as it is in FIG. 13 and the second pair of electric contacts 74 and 75, thereby informing the controller that the door is now open.

The latching element 49 can also be operated by means other than an electromagnet coil 45 as is demonstrated in FIG. 14. In this case, the rotor 26A can be identical with that in FIGS. 12 and 13. The same latching element 49 can be used as is used in the other embodiments. The same spring contact member 54 that is used in the other embodiments can also be used in the FIG. 14 arrangement. Preloaded flat spring 54 has a contact point 55 mounted to it. Contact point 55 resides in a notch 65. The active element is a bimetal strip 80 which terminates in a hooked end 81 after having passed through slot 65. Hooked end 81 is superimposed over laterally extending end portion 53 of latching element 49. An electrically insulating, thermally conductive member 82 wraps around bimetal strip 80. The bimetal strip is anchored at one end 83 to bracket 51. An electric heater wire 84 surrounds insulator 82. When current is passed through heater wire 84, the bimetal deflects or curves downwardly, thereby causing hooked end 81 to move downwardly and pull latching element 49 downwardly with it, so the end 53 of the latching element is placed in blocking position in the path of stop surface 73 on latching member 26A. This arrangement has time delay properties. It is desirable to keep the door closed long enough so that in any case the spinning basket will have an opportunity to coast to a stop before it is accessible. The time delay is achieved inherently by the time it takes to dissipate the heat from wire 84 and the insulating layer 82 so that the spring 52 can rock the latching element 49 out of the path of stop surface 73 on latch member 26A.

In FIGS. 15 and 16, a wax motor, designated generally by the numeral 90, is used to operate latching element 49 for keeping the door locked until it can be opened safely. In FIG. 15, the latching element 49 is presently in its unoperated state wherein its tip or end portion 53 is not interposed in the path of stop surface 53 on latching member 26A. The wax motor is comprised of a sealed cylinder 91 that is filled with wax having particular thermal properties. There is a piston, not shown, inside of cylinder 91 from which a piston rod 92 extends. The piston rod is connected to latching element 49 at a place marked. 93. The rod 92 is connected to latch element 49 in such manner that the piston rod can exert a downward pulling force or an upward pushing force on latching element 49. The latching element pivots on an axis 94. On one side of the cylinder there is a positive temperature coefficient heating element 95 contact with wax filled cylinder 91. A coil spring 96 is fastened to latch element 49 at point 97 at one end and is hooked to a pin 98 at the other end. In FIG. 15, the prestress in spring 96 has rocked latching element 49 to its counterclockwise limit which means that the piston, not visible, in the cylinder 91 is driven downwardly in the wax within cylinder 91. An electrical contact is symbolized by the rectangle 99 for conducting current through the heating element 95. Contact 99 may connect to a positive source of electricity and the cylinder 91 may be grounded to establish a conductive path through heater element 95. When heated, the wax goes through a phase change from solid to liquid, and its volume increases substantially by about 50%. Typically, the wax melts at 250° F. (121° C.) at which time the piston begins to move up and latch element 49 in FIG. 15 begins to move counterclockwise. In practice, current flow through the heating element 95 is continued until the wax is at a 350° (282° C.) to maximize driving force. Thus, there is a slight delay between the time that the controller initiates current flow through the heating element of the wax motor and the time that the latching element 49 can obstruct rotation of rotatable latching member 26A and allow contacts 55 and 56 to close. Typically, the wax motor can develop a thrust force of about 10 pounds (4.5 kg) in about a ¼ inch (6.45 mm) stroke. FIG. 17 is a left side elevational view of the device depicted in FIG. 16 whose primary surface is to show that two springs are used to drive the piston down into the cylinder 91 of the wax motor when current flow through the heating element 95 is discontinued under the influence of the controller. Upon this event, the heating element cools and converts back to a solid state, providing a time delay upon release.

Although variations of the new door latching and switching device have been described in detail, such description is intended to be illustrative, rather than limiting, for the invention may be variously embodied and is to be limited only by interpretation of the claims which follow.

It is claimed:

1. A switch and latching device adapted for latching a closure member, such as the lid, cover or door of an enclosure, including:

a housing, an actuator mounted in the housing for rotating about an axis in forward and reverse directions, the actuator having first and second members extending radially outwardly of the axis and angularly spaced apart about the axis, a striker member for being mounted to the closure member and constructed and arranged for striking the first radially extending member and entering the space between the radially extending members of the actuator when the closure member closes to thereby rotate the actuator in the forward direction, a latching member coupled to said actuator for rotating in said housing in forward and reverse directions through angles corresponding to the angles of rotation of the actuator caused by the striker member acting on the actuator, return spring means for biasing said latching member and actuator toward rotating in said reverse direction in opposition to the force of said striker that causes the latching member and actuator to rotate in the forward direction, a latching element and a restoring spring urging said element into an inactive position and the element is mounted for being moved into an active position wherein it can interfere with the latching member rotating in the reverse direction after having been rotated in the forward direction by the striker member when the closure member is closed, and a force generator that responds to a signal by moving the latching element into the active position for interfering with the latching member to thereby keep the closure member latched, discontinuance of the signal allowing said restoring spring to restore said latching element to the inactive position so the closure member can be opened.

2. The device according to claim 1 wherein said force generator is comprised of an electromagnet including a coil and pole piece and said latching element is magnetically attractable to the pole piece when an electric signal is supplied to said coil for moving the latching element into active position for interfering with said latching member.

3. The device according to claim 2 wherein said pole piece is comprised of a material having high magnetic remanence causing said latching element to remain in an active position wherein it interfaces with said latching member provided that the latching member has allowed the latching element to engage the pole piece when said coil was energized by a first electrical signal such that release of the latching element is achieved by applying to the coil a second electrical signal having a lower energy than the first signal to release the latching element.

4. The device according to claim 2 wherein said pole piece is permanently magnetized and has sufficient magnetic strength to retain the latching element in active position wherein it interferes with movement of said latching member with momentary assistance of an electric signal applied to said coil provided said latching member has allowed the latching element to engage the pole piece when a first electric signal was applied to the coil, such that said latching element is releasable by a lower level electric signal of reverse polarity.

5. The device according to claim 2 wherein said latching member has an axis of rotation and said return spring means is a pretensioned spring having opposite ends, one of which is anchored and the other of which is attached to said latching member at a place radially spaced from said axis to provide a bistable door retaining latch.

6. The device according to claim 1 wherein said force generator is comprised of a bimetal element fixed at one place and engageable with said latching element at another place, an electric heating element in heat exchange relationship with said bimetal element such that when electric current flows through said heating element said bimetal deflects for positioning said latching element in active position for interfering said latching member.

7. The device according to claim 1 wherein said force generator is comprised of a wax motor including a body containing a substance having a high coefficient of expansion a piston in the body and a piston rod extending from the body and operatively coupled to said latching element, a heating element in heat exchange relationship with the body such that when electric current flows through said heating element said substance expands to cause said latching element to be moved to active position for interfering with said latching member.

8. The device according to claim 1 wherein said return spring means for biasing said latching member and actuator toward rotating in said reverse direction is a torsion spring having opposite ends, one of which is anchored and the other of which is attached to said latching member.

9. The device according to claim 1 including a movable electric contact and a stationary electric contact in said housing, moving said latch element into interfering position driving said movable contact into engagement with said stationary contact to complete a circuit for conducting a signal indicative of the latch element being in interfering position.

10. The device according to any one of claims 1, 5, 6 or 7 wherein:

said latching member is comprised of a body having a periphery radially spaced from the axis of rotation of the latching member, the periphery constituting a segment of a large radius curve terminating at a place having a smaller radius than the periphery to thereby define a stop, said latching element is comprised of an elongated member having nominally top and bottom surfaces and opposite end portions, the element mounted for rocking on an axis positioned between the end portions, one end portion of the latching element on one side of the axis for rocking extending over said latching member and the latching element having an opening near said one end portion, a conductive flat spring superposed on said top surface and having opposite end regions one of which is fastened to said latching element and the other of which extends over said one end portion of said latching element, the flat spring having a first electric contact presented in said opening of the element, a second electric contact mounted fixedly in said housing proximate to said latching member and aligned with said first electric contact, said first electric contact on the flat spring being blocked against contacting said second electric contact by said one end portion of the latching element being superposed over said segment of the periphery of the latching member when said latching member is in a rotational position corresponding to said actuator not being actuated by the striker member, rotation of the actuator in said forward direction by said striker member causing said latching member to rotate the latching member segment to no longer block the latching element against rocking sufficiently for said first electric contact on the flat spring to make contact through said opening with said second contact such that when an electric signal is applied to said force generator said latching element end portion moves into interfering relation relative to said stop so the latching member cannot rotate in a direction corresponding to said actuator rotating in said reverse direction and so the striker member on the closure member cannot be withdrawn from said actuator.

11. The device according to claim 1 wherein said latching member is provided with a stop which, when said actuator is rotated in said forward direction against the force of said return spring by said striker member rotating the actuator and said latching element is in said active position interferes with said actuator returning to the inactive position to thereby maintain the closure member latched, the device further comprising a first electric contact supported on the latching element for moving with the latching element and a second stationary electric contact which the first electric contact contacts when the latching element is in active position, the first and second contacts being in a circuit for conducting a signal indicating when the closure member is closed and also latched.

12. The device according to claim 11 including third and fourth normally open electric contacts adjacent said latching member, rotation of said latching member in a direction corresponding to said actuator being rotated under the influence of the striker member in said forward direction causing said latching member to close said third and fourth contacts for conducting a signal indicative of the closure member being closed whether or not the closure member is latched.

13. The device according to claim 1 including a shaft that is journaled for rotation in said housing and on which said actuator and latching member are fixed for being coupled to rotate through corresponding angles.

14. The device according to claim 13 wherein said actuator and latching member are spaced apart axially on said shaft, a compartment in said housing that is spanned by said shaft, said housing having a drain hole in communication with said compartment, and a drip disk on said shaft in said compartment for expelling any liquid that might migrate along the shaft.

15. The device according to claim 1 adapted to inhibiting rotation of the actuator with an unauthorized object while the closure member is open and the striker member is not in the actuator, said housing having an opening providing access to said actuator to an angular position wherein the space for admission of the striker member between said first and second radially extending members (36,37) of the actuator is presented toward said opening in the housing, said first radially extending member is designated as the leading member reckoned in the forward direction of rotation the actuator and the second radially extending member is designated the trailing member, a first blocking element (44) fixed in said housing adjacent the rotational path followed by said leading and trailing members of the actuator, the blocking element (44) constructed and arranged with insufficient clearance relative to the leading and trailing members to pass if an unauthorized object is used in an attempt to rotate the actuator.

16. The device according to claim 15 including a second blocking element spaced apart from said first blocking element, the blocking elements (42,43) fixed in said housing along the rotational path of said leading and trailing members, the blocking elements (42,43) are constructed and arranged for at least part of the leading member to enter between said elements (42,43) when rotating.

17. The device according to any one of claims 1, 15 or 16 wherein:

said second radially extending member (37) of the actuator (24) has an external surface (32), radially remote from the axis of rotation, which surface is slanted for inducing an unauthorized object to slip from the surface if application of the object to the surface should begin to turn the actuator.

18. The device according to claim 1 wherein said second radially extending member (37) of the actuator (24) is substantially longer in opposite axial directions than the first radially extending member (36).

19. The device according to claim 17 wherein said second radially extending member (37) of the actuator (24) is substantially longer in opposite axial directions than the first radially extending member (36).

20. A device for automatically locking a door on an enclosure comprising:

a striker member mounted to the door and constructed and arranged for passing through an opening with which the door cooperates when the door is closing, a housing for mounting in the enclosure, the housing having an aperture for the striker member to enter the housing when the door is closed, an actuator body in the housing mounted for rotating about an axis in forward and reverse directions, the actuator body having an open slot extending generally radially-outwardly of the axis for the striker member to enter and rotate the actuator body in said forward direction when the door closes, a cam member coupled to said actuator body for rotating coaxially in the housing in forward and reverse directions correspondingly with the actuator body, the cam member having a peripheral surface constituting a segment of a circle that terminates in the circumferential direction to thereby define a radially extending stop element, a restoring spring operative to urge the actuator body in said reverse direction to an initial rotational position wherein the opening of said slot in the body is presented toward the opening of the door for said striker member to enter the slot and rotate the actuator and said cam member in said forward direction when the door is closing, an electromagnet assembly including a coil and a core that is magnetized when current flows in the coil, a magnetically attractable latching element mounted for pivoting proximate to said core and a spring arranged for urging said latching element in a direction away from the core and when current flows through said coil the resulting magnetic force attracts said latching element member toward the core and into a cam member interfering position, the latching element having one end portion that extends over said peripheral surface of the cam member and when the cam member is rotated in said first direction and the said stop element on the cam member rotates past said end portion of the latching element if the coil is energized the latching element moves into interfering position relative to the stop element, whereby said cam member and actuator cannot rotate in the reverse direction under the influence of said restoring spring so the door cannot be opened.

21. The device according to claim 20 including:

an elongated conductive flat spring member overlaying said latching element on a side of the latching element opposite of the side facing the core and the cam member, said latching element having an opening proximate to its end portion and said flat spring member having an electric contact point positioned in the opening, and said spring member biased against the surface of the latching element, a stationary contact point mounted in alignment with said contact point on the spring member and the latter contact point being prevented from touching said stationary contact point through said opening unless said cam member is rotated for moving said peripheral surface of the cam member out of the way of said end portion of the latching element end portion.

22. The device according to any one of claims 20 or 21 wherein said slot in said actuator body is defined by first and second elements extending radially of the rotational axis of the body and angularly spaced from each other, said housing having a chamber in which said elements are disposed, said chamber having a drain hole.

23. The device according to claim 22 wherein said first radially extending element is designated the leading element when said actuator is rotating in said forward direction and said second radially extending element is designated the trailing element and said trailing element is substantially longer in opposite axial directions than the leading element.

24. The device according to claim 22 wherein said second element extending radially from the actuator body axis has a curved profile to minimize the probability of a force applied with an object to said second radially extending element successfully rotating the actuator.

25. The device according to claim 20 including a shaft on which said actuator body and cam member are mounted in axially spaced apart relationship, a chamber in said housing through which a part of the shaft between said actuator body and cam member passes, said chamber having a drain hole, a drip ring on said part of the shaft in the chamber for intercepting any liquid migrating along the shaft and directing it to the chamber for draining out of said drain hole.

26. The device according to claim 22 including blocking elements fixed in said housing which are constructed and arranged for being passed with small clearance by said first and second radially extending members when rotated by said striker member that is disposed in the slot, said blocking elements standing in the way of any object applied to said actuator outside of said slot in an attempt to rotate the actuator without the object being disposed in the slot.

27. The device according to claim 21 including another pair of electric contacts at least one of which is movable relative to the other in said housing, and said cam member has a projection which forces the one contact to connect with the other when said cam member is rotated to close a circuit for providing a signal indicating that the door is closed whether or not the door is locked.

* * * * *